United States Patent [19]

Kizu et al.

[11] 4,125,399

[45] Nov. 14, 1978

[54] APEX SEALS FOR ROTARY PISTON ENGINES

[75] Inventors: Fumio Kizu, Hiroshima; Kazuyoshi Hanano, Aki; Kaoru Sotoyama, Saiki; Masayoshi Matsuo, Aki, all of Japan

[73] Assignee: Toyo Kogyo Co., Ltd., Aki, Japan

[21] Appl. No.: 828,033

[22] Filed: Aug. 26, 1977

[30] Foreign Application Priority Data

Aug. 31, 1978 [JP] Japan ..... 51-104780

[51] Int. Cl.[2] ..... C22C 38/42; C22C 38/46; C22C 38/54

[52] U.S. Cl. ..... 75/125; 75/128 C; 75/128 D; 75/128 F; 75/128 V; 75/128 W

[58] Field of Search ..... 75/125, 128 D, 128 CF, 75/123 CB, 128 V, 128 W; 148/35

[56] References Cited

U.S. PATENT DOCUMENTS

| | | | |
|---|---|---|---|
| 3,658,451 | 4/1972 | Gomada | 277/81 P |
| 3,802,927 | 4/1974 | Gomada | 148/35 |
| 3,830,601 | 8/1974 | Yamazaki | 148/35 |
| 4,025,366 | 5/1977 | Ruf et al. | 148/35 |

FOREIGN PATENT DOCUMENTS

| | | | |
|---|---|---|---|
| 38-11,253 | 1963 | Japan | 75/123 CB |
| 48-25,289 | 7/1973 | Japan | 148/35 |
| 259,390 | 5/1970 | U.S.S.R. | 75/125 |
| 447,454 | 4/1975 | U.S.S.R. | 75/125 |
| 455,164 | 12/1975 | U.S.S.R. | 75/125 |

*Primary Examiner*—Arthur J. Steiner
*Attorney, Agent, or Firm*—Fleit & Jacobson

[57] ABSTRACT

Apex seal for rotary piston engines made of an iron-based material containing in weight 2.5 to 4.0% of C, 0.5 to 2.8% of Si, less than 1.0% of Mn, 0.25 to 2.0% of Ni, 0.25 to 2.0% of Mo, 0.25 to 2.0% of Cu, 0.15 to 0.4% of B, 0.15 to 1.5% of Cr, 0.1 - 0.4% of V and the balance of substantially iron. The material is of a chilled structure which is produced when the material is casted without any specific cooling. The apex seal provides remarkably improved wear and impact resistant properties.

2 Claims, 8 Drawing Figures

APEX SEALS FOR ROTARY PISTON ENGINES

The present invention relates to apex seals for rotary piston engines and more particularly to apex seals of such materials that have both wear-resistant and shock resistant properties.

Conventional rotary piston engines comprise a casing which includes a rotor housing having an inner wall of trochoidal configuration and a pair of side housings gas-tightly secured to the opposite sides of the rotor housing to define a rotor cavity of trochoidal configuration. In the rotor housing, there is rotatably disposed a rotor of polygonal or usually a triangular configuration. The rotor includes a plurality of apex portions which are adapted to slidably engage the inner wall of the rotor housing so as to divide the rotor cavity into a plurality of working chambers having volumes which vary in response to the rotation of the rotor.

In order to provide a gas-tight seal across the adjacent working chambers, the rotor is provided at each apex portion with a so-called apex seal. For the purpose, each apex portion of the rotor has an axially extending seal groove in which an elongated seal is received. The seal is resiliently biased against the inner wall of the rotor for sliding engagement therewith and moves along the inner wall of the rotor at a substantial speed as the rotary engine is operated. Thus, the apex seal must be of a highly wear-resistant material which is also durable to heat applied by engine combustion gas and produced in the seal due to the friction between the apex seal and the rotor housing wall.

Further, the apex seal is also subjected to cyclic impact loads in use. Since the apex seal is used for gas-tightly separating two adjacent working chambers, when combustion takes place in one of the working chambers, the apex seal is forced under the pressure of combustion gas toward one of side walls of the seal groove in the rotor. As the rotor further rotates, combustion takes place in the other working chamber so that the apex seal is then forced toward the other direction under the pressure of combustion gas in said other working chamber. Thus, the apex seal is cyclically bumped against the side walls of the apex seal groove and therefore it is subjected to cyclical lateral impact loads of substantial value. Further, the movement of the apex seal is such that it is not always in close sliding contact with the inner wall of the rotor housing but cyclically moved away from the inner wall under the inertia force and again brought into bumping engagement with the inner wall under the biasing force and the centrifugal force on the apex seal. This movement of the apex seal causes cyclic impact loads thereon.

Therefore, it will be understood that the apex seal should desirably be made of an impact and wear resistant material, however, it has been practically difficult to obtain a material which is satisfactory in respect of both impact and wear resistant properties since an improvement in the impact resistant property has generally caused poor wear resistant property. For example, proposals have been made of providing apex seals by a sintered alloy containing substantial amount of carbides such as TiC or by a cast iron containing high percentages of boron. Such apex seal materials have been found as possessing a satisfactory hardness as well as a superior wear resistant property, however, it does not have an adequate impact resistance. Therefore, in the known apex seals of the type that are made of the aforementioned materials, impact resistance has been provided by increasing the dimension, that is, the height and the thickness of the seal. However, such increase in the dimension of the apex seal is not recommendable from the view point of engine performance because any increase in the mass of the apex seal causes an increase in the sliding drag.

There has also been proposed by Japanese patent application Sho 50-12142 which has been disclosed for public inspection and at the same time published in Japanese Patent Gazette on July 30, 1976 under the disclosure number of Sho 51-87117 to provide an apex seal by a totally chilled cast iron. According to the proposal, the apex seal is made of a totally chilled iron-based material containing in weight 2.5 to 2.8% of total carbon, 1.5 to 3.0% of silicon, 0.5 to 1.0% of manganese, less than 0.30% of phosphorus, less than 0.10% of sulphur, 0.3 to 1.0% of chromium, 0.4 to 1.0% of molybdenum, 0.4 to 1.0% of nickel or copper, 0.02 to 0.10% of boron and the balance of iron. However, this type of apex seal has been dissatisfactory in respect of wear-resistant property.

It has also been proposed by the U.S. Pat. No. 3,658,451 to provide a layer of chilled structure only in the sliding surface of an apex seal. In this type of apex seal, the wear-resistant property is provided by the layer of the chilled structure while the impact resistant property is provided by the basic cast iron material. The proposed apex seal is advantageous in that both of the wear resistance and the impact resistance can be provided without increasing the dimension of the seal. However, this type of apex seal has been found disadvangeous in that it comprises two layers of different coefficient of thermal expansion so that it is deformed under the heat produced in the engine operation and cannot maintain a line contact with the inner wall of the rotor housing throughout its length. Such deformation of the apex seal causes pressure leakage from one working chamber to another. Further, local non-uniform contact of the apex seal with the inner wall of the rotor housing may cause scratches therein possibly damaging the chromium plate layer on the rotor housing inner wall.

It is therefore an object of the present invention to provide a material for apex seals of rotary piston engines which possesses both wear-resistant and impact resistant properties.

Another object of the present invention is to provide apex seals for rotary piston engines which are satisfactory in respect of sealing property and do not have any adverse effect on the engine performance.

A further object of the present invention is to provide apex seals for rotary piston engines in which the aforementioned disadvantages of prior art have been overcome.

According to the present invention, the above and other objects can be accomplished by an apex seal for rotary piston engines which is made of an iron-based material containing in weight 2.5 to 4.0% of C, 0.5 to 2.8% of Si, less than 1.0% of Mn, 0.25 to 2.0% of Ni, 0.25 to 2.0% of Mo, 0.25 to 2.0% of Cu, 0.15 to 0.4% of B, 0.15 to 1.5% of Cr, 0.1–0.4% of V and the balance of substantially iron, said material being of chilled structure throughout the apex seal. Said material may contain impurities such as phosphorus and sulphur. The chilled structure is provided simply through casting of the material without any specific cooling means.

According to the concept of the present invention, the wear-resistant property is provided by the chilled structure and also by wear-resistant carbides of such elements, for example, B, Cr and V, that are essential in forming the chilled structure. Since boron has a remarkably adverse effect on the impact resistance, the amount of boron is maintained as small as possible within a limit in which a desired wear resistant property is obtained.

Although there is a decrease in the impact resistance due to the boron content, such decrease is compensated for by addition of Ni, Cu, Mo and V. The boron content has been known as having a significant effect on the promotion of producing chilled structures but having a tendency of making the structure brittle. The V content has, when added by a suitable amount, an effect of producing fine chilled structures which contribute to improve the ductility.

Thus, according to the present invention, an uniform chilled structure can be obtained throughout the body of the apex seal simply by casting the material without using any cooling means. It has been found that the chilled structure in accordance with the present invention has a wear resistance which is fifty percent higher than that obtained by a conventional apex seal made of an acicular cast iron having a chilled sliding surface. Although the apex seal has a chilled structure throughout the body thereof, it has also been found that the impact resistance thereof is fifty percent higher than that obtained by a conventional apex seal because the apex seal of the present invention has a fine structure and added with Ni, Cu and Mo. It will thus be understood that the apex seal of the present invention is made of a material which possesses both the wear resistant and the impact resistant properties. According to the present invention, therefore, it is not necessary to increase the dimension of the apex seal for the purpose of providing an adequate impact resistance. Further, it is possible to eliminate any thermal deformation. As the result, the apex seal in accordance with the present invention can provide an improved sealing property which contributes to an increase in the engine output as well as an improvement in fuel consumption. The fact that the apex seal has a uniform structure throughout the body thereof is effective to eliminate any thermal deformation. Moreover, since the apex seal has a chilled structure throughout the body thereof, the coefficient of thermal expansion is very small so that the thermal expansion of the apex seal can be maintained very low. This fact also contributes to the improvement of the sealing property.

According to the present invention, the amount of carbon content has been determined taking into consideration the fact that with the carbon content less than 2.5% in weight there will not be adequate eduction of carbides so that a satisfactory wear resistance cannot be obtained, while with the carbon content exceeding 4.0% in weight the material will become brittle due to a formation of excessive eutectic alloy.

With the Si content less than 0.5%, an adequate casting property cannot be maintained, while, with the Si content exceeding 2.8%, there will be an adverse effect on the production of the chilled structure due to an increase in the amount of educed graphite. Manganese is added for the purpose of desulphurizing but it should not exceed 1.0% because an excessive Mn content has a tendency of making the structure brittle. Nickel, molybdenium and copper are added for the purpose previously discussed. However, they have no adequate improvement on the impact resistance where their contents are less than 0.5% but there will be no further improvement even when they are added more than 2.0%.

Boron is the most important element because it produces hard carbides or composite carbides and has an effect of making it possible to produce a chilled structure simply by casting the material without any means for cooling. Thus, boron is essential in maintaining the wear-resistant property. With the boron content less than 0.15%, an adequate effect cannot be obtained but, with the boron content exceeding 0.4%, there is a remarkable tendency of producing a brittle structure and such defects cannot be eliminated by the addition of Ni, Cu, Mo and V.

The boron content must be maintained as small as possible because excessive boron content leads to the disadvantages as discussed above. Therefore, it is practically unrecommendable to provide an adequate wear-resistant property solely by the addition of boron. Thus, chromium is added for supplementarily providing the wear-resistant property. With the Cr content less than 0.15%, however, the effect is not sufficient but with the Cr content exceeding 1.5% there will be an adverse effect on the machining property.

Vanadium is one of the most important elements in accordance with the present invention. It produces carbides and has an effect of supplementing the effect of boron in producing a chilled structure simply by casting the material without any specific cooling means. It further has an effect of producing a fine structure which serves to compensate for the adverse effect of boron which makes the chilled structure brittle. The carbides produced by the addition of V provide an improved wear-resistant property. With vanadium content less than 0.1%, an adequate effect cannot be obtained. However, where the V content exceeds 0.4%, there will be an adverse effect of producing a brittle structure due to an excessive amount of carbides.

The present invention will further be described by way of examples taking reference to the accompanying drawings, in which:

FIG. 1(*b*) is a sectional view taken along the line B—B in FIG. 1(*a*);

FIG. 1(*c*) is a perspective view of an apex seal;

FIG. 3(*b*) is a diagram showing the relationship between the amount of wear and the vanadium content;

Figure 4:
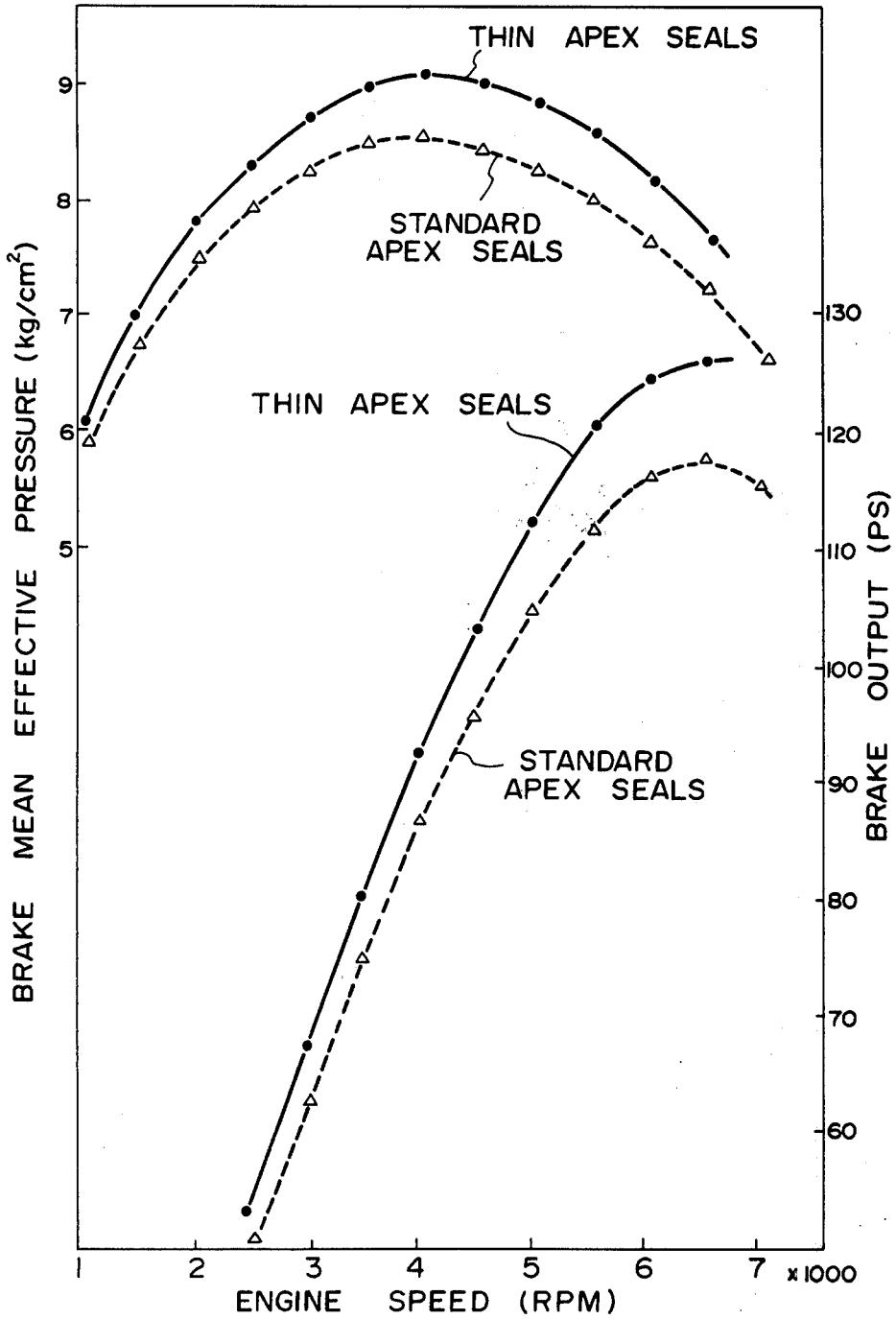
Figure 5:
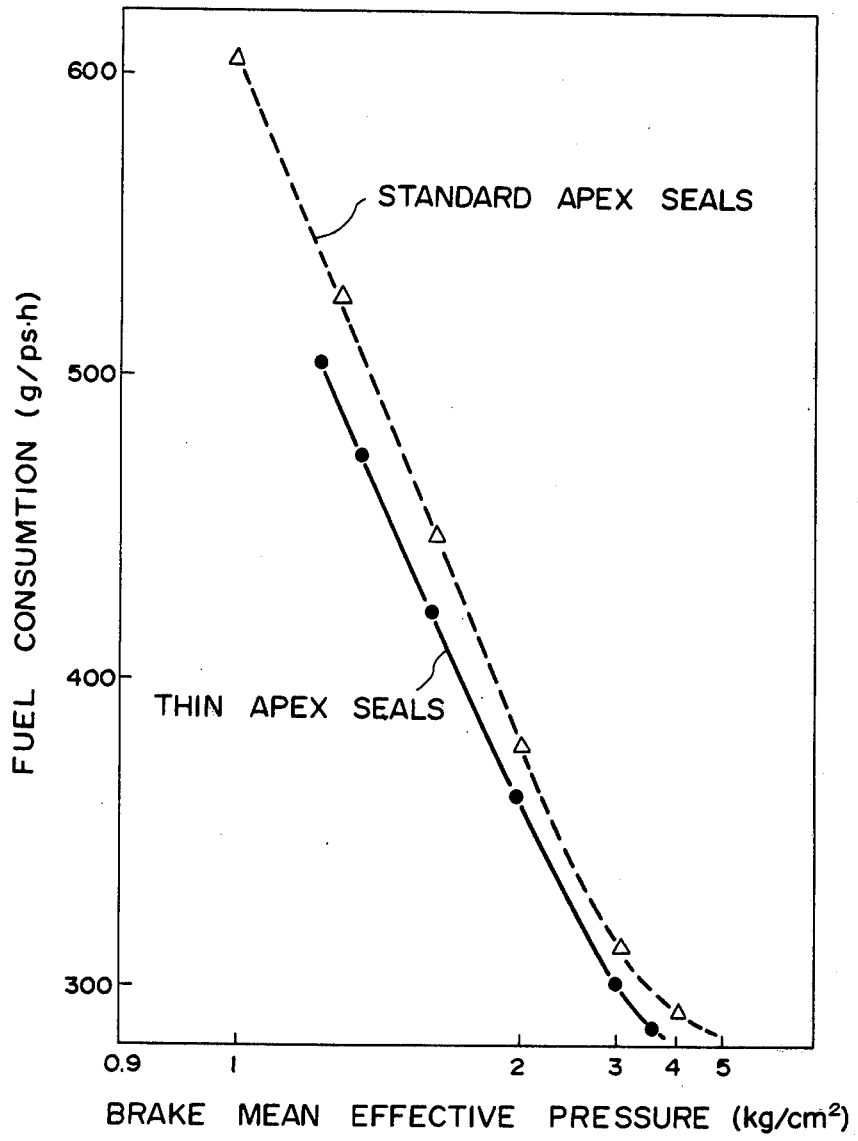

FIG. 4 is a diagram showing the brake mean effective pressure and the brake output in a rotary piston engine equipped with apex seals in accordance with the present invention as well as those in a rotary piston engine equipped with conventional apex seals; and FIG. 5 is a diagram comparing the fuel consumption in a rotary piston engine equipped with apex seals in accordance with the present invention with that in a rotary piston engine having conventional apex seals.

Figure 1A:
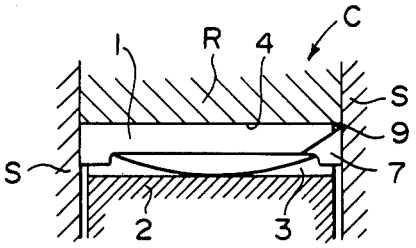
FIG. 1(*a*) is a fragmentary sectional view of a rotary piston engine to which the present invention can be applied.
Figure 1B:
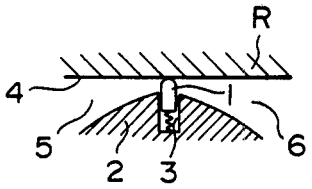
Figure 1C:
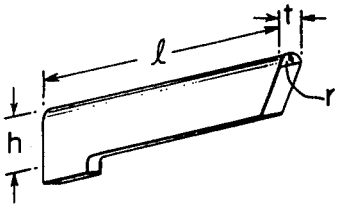

Referring to the drawings, particularly to FIGS. 1(*a*) and (*b*), the rotary piston engine shown therein includes a casing C which comprises a rotor housing R having an inner wall 4 of trochoidal configuration and a pair of side housings S secured to the opposite sides of the rotor housing R. In the casing C, there is disposed a rotor 2 of triangular configuration. The rotor is formed at each apex portion with a groove 3 in which an apex seal 1 is received. The apex seal 1 is biased radially outwardly by means of a spring 8 which acts on the apex seal 1 and a wedge-shaped end piece 7. Thus, the apex seal 1 is thus forced into contact with the inner wall 4 of the rotor housing R and separates working chambers 5 and 6. The present invention can be applied to the apex seal 1.

EXAMPLES

Apex seals were produced from the materials listed in Table I. The apex seals had a configuration as shown in FIG. 1(*c*) wherein the height *h* was 8.5 mm, the length *l* 80 mm, the thickness *t* 2.3 mm and the radius of curvature of the sliding surface *r* 2.0 mm. The materials were at first molten in an electric furnace and poured into shell moulds where the materials were cooled down until they were solidified. Then, the moulded parts were maintained at the temperature of 300° to 600° C. to remove strains and machined to the above dimensions.

The samples listed in Table I were subjected to the following tests and the results were compared with those obtained from a conventional apex seal made of an acicular cast iron having a sliding surface of a chilled structure. The dimensions of the conventional apex seal were the same as those of the samples except that the thickness *t* was 3 mm.

Table I

| SAMPLE | C | Si | Mn | P | S | Ni | Cr | Mo | V | B | Cu | OTHERS |
|---|---|---|---|---|---|---|---|---|---|---|---|---|
| 1 | 3.32 | 2.23 | 0.5 | 0.065 | 0.03 | 1.5 | 0.82 | 1.38 | 0.15 | 0.31 | 1.10 | Ti 0.3 |
| 2 | 3.35 | 2.10 | 0.42 | 0.065 | 0.02 | 1.35 | 0.51 | 1.53 | 0.20 | 0.25 | 1.00 | Nb 0.5 |
| 3 | 3.36 | 1.02 | 0.73 | 0.063 | 0.03 | 2.4 | 1.0 | 2.0 | 0.10 | 0.30 | 0.97 | — |
| 4 | 3.40 | 2.30 | 0.41 | 0.063 | 0.03 | 1.03 | 0.52 | 1.35 | 0.12 | 0.20 | 1.20 | — |
| 5 | 3.42 | 1.83 | 0.52 | 0.063 | 0.02 | 2.5 | 0.48 | 1.50 | 0.15 | 0.38 | 0.70 | — |
| 6 | 3.45 | 1.75 | 0.50 | 0.060 | 0.03 | 1.03 | 0.50 | 1.15 | 0.17 | 0.15 | 0.83 | W 0.5 |
| 7 | 3.48 | 2.20 | 0.49 | 0.065 | 0.02 | 2.00 | 0.49 | 0.50 | 0.12 | 0.25 | 1.30 | — |
| 8 | 3.50 | 2.16 | 0.45 | 0.063 | 0.02 | 1.80 | 0.53 | 1.51 | 0.18 | 0.20 | 0.78 | Ti 0.5 |
| 9 | 3.52 | 2.30 | 0.50 | 0.065 | 0.03 | 1.00 | 0.48 | 1.35 | 0.20 | 0.20 | 1.30 | — |
| 10 | 3.57 | 2.23 | 0.41 | 0.061 | 0.03 | 1.03 | 0.50 | 1.37 | 0.11 | 0.15 | 0.63 | — |

Wear Test

1. Test Procedure:

A rotatable disc having a chromium plated surface was prepared and the specimens were maintained in sliding contact with the rotating disc. The amount of wear was measured in terms of decrease in the height of the apex seal.

2. Test Conditions:

Back-up Pressure; 4.5 Kg

Sliding Speed; 5 m/sec.

Time; 20 min.

Lubrication; None

3. Test Results:

The Results are shown in Table II.

Table II

| SAMPLES | 1 | 2 | 3 | 4 | 5 | 6 | 7 | 8 | 9 | 10 | PRIOR ART |
|---|---|---|---|---|---|---|---|---|---|---|---|
| WEAR (μ) | 40 | 36 | 38 | 37 | 32 | 44 | 38 | 39 | 36 | 37 | 55 |

From the test results, it will be noted that the apex seals in accordance with the present invention have superior wear resistant property as compared with the conventional apex seal.

Impact Tests

The samples as listed in the Table I were subjected to impact tests and the results were compared with those obtained from the conventional apex seal.

Figure 2:
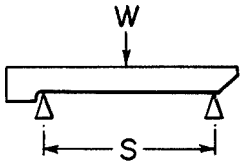
FIG. 2 is a side view showing a typical method of impact test which is applied to the apex seal of the present invention.

1. Test Procedure:

In order to simulate the servicing conditions of the apex seals in engines, the samples were subjected to 50 cycles of heating, each cycle comprising heating the sample to the temperature of 400° C. for 10 minutes and then cooling it down in water. The samples were then subjected to impact tests in a manner as shown in FIG. 2, wherein the distance S was 50 mm. The test results were measured in terms of the impact load W at which the specimen was broken. The same tests were also conducted on samples which were not subjected to repeated heating cycles. The results are shown in Table III.

Table III

| SAMPLES | 1 | 2 | 3 | 4 | 5 | 6 | 7 |
|---|---|---|---|---|---|---|---|
| WITHOUT HEATING | 15.9 | 16.7 | 16.7 | 17.9 | 15.9 | 22.7 | 18.7 |
| WITH HEATING | 16.7 | 18.2 | 18.1 | 19.5 | 17.3 | 24.6 | 19.6 |

| SAMPLES | 8 | 9 | 10 | PRIOR ART |
|---|---|---|---|---|
| WITHOUT HEATING | 17.1 | 18.3 | 15.9 | 13.7 |
| WITH HEATING | 18.0 | 19.8 | 17.0 | 12.7 |

Values are in Kg.m/cm$^2$

From the table, it will be noted that the apex seals in accordance with the present invention have impact resistance which is significantly higher than that of the conventional apex seal. Although the test specimens of the apex seals in accordance with the present invention were 2.3 mm thick, it should be noted that similar results would be obtained with specimens of 3.0 mm thick. The test results shown in Table III apparently show that the materials of the apex seal in accordance with the present invention have superior impact resistance as compared with the conventional apex seal material. Thus, according to the present invention, it is unnecessary to have an apex seal of increased dimension since an adequate impact resistance can be provided even in an apex seal of smaller dimension.

It should further be noted that in the apex seal of prior art the impact resistance is decreased after heating, however, in the apex seals of the present invention, there is an increase in the impact resistance after heating. It is understood that in the conventional apex seal the material became brittle through the application of heat shock because the grains of the unchilled casting material are grown when heated. By the contrary, according to the present invention, the material is less sensitive because the apex seal has a chilled structure throughout the body thereof.

The effect of boron content was thereafter investigated. For the purpose, the wear and impact tests were performed with samples having the same compositions as the sample 1 except that the boron content was changed. The results are shown in FIG. 3(*a*).

Figure 3A:
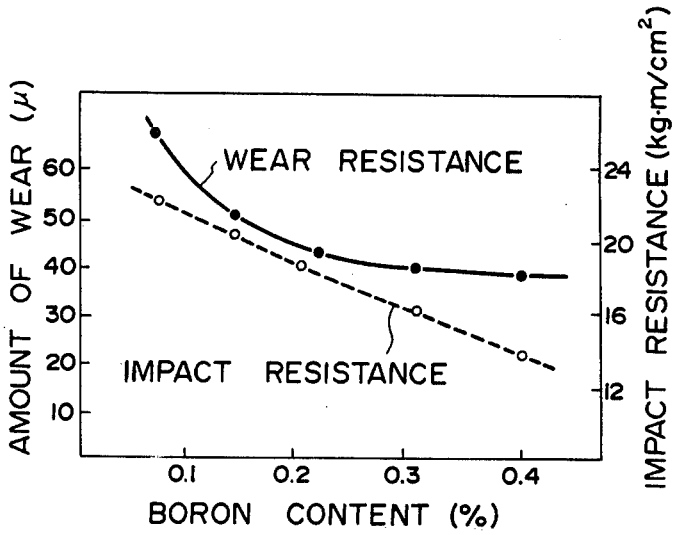
FIG. 3(*a*) is a diagram showing the relationship between the amount of wear and the boron content.
Figure 3B:
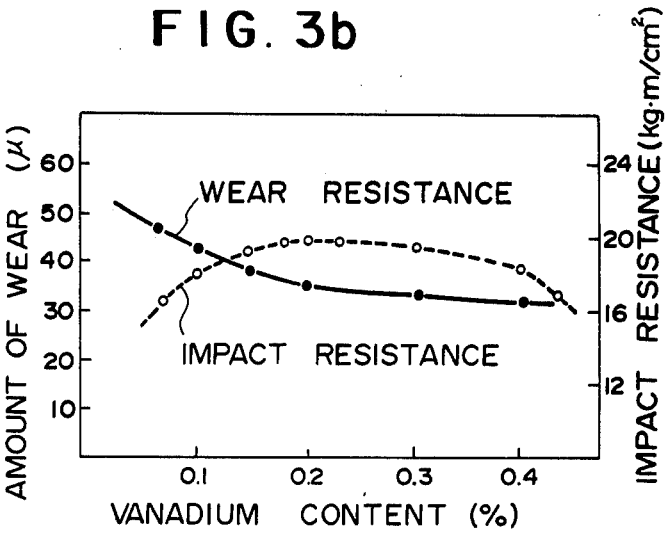

It will be noted in FIG. 3(*a*), with the boron content less than 0.15%, the amount of wear exceeds 50 microns so that the wear resistant property is unsatisfactory. Further, with the boron content exceeding 0.4%, the impact resistance decreases below 13 kg.m/cm$^2$ so that the apex seal can no longer have required strength.

Further investigations have been made on samples of such compositions that are the same as those of the sample 9 except having various vanadium contents so as to find the effect of vanadium. The samples were subjected to the wear and impact tests and the results are shown in FIG. 3(*b*).

In FIG. 3(*b*), it will be noted that where the vanadium content is less than 0.1% the amount of wear exceeds 43 microns and at the same time there is a decrease in the impact resistance. With the vanadium content exceeding 0.4%, there is no further improvement in the wear-resistant property in response to an increase in the vanadium content. Further, there is a noticeable decrease in the impact resistance.

Thus, according to the present invention, it is possible to provide an apex seal which is satisfactory in respect of both the wear and impact resistant properties by using an iron based material containing 0.15 to 0.4 percent in weight of boron and 0.1 to 0.4 percent in weight of vanadium. In accordance with the present invention, the dimension of the apex seal can even be decreased to provide desired properties and the seal is substantially free from any thermal distortion.

In Tables II and III, it will be noted that in accordance with the present invention the values on the wear and impact resistance properties are fifty percent higher than those in the conventional apex seals. Therefore, it is even possible to decrease the dimensions of the apex seal in the present invention to provide the wear and impact resistant properties which are equivalent to those of the conventional apex seal having normal dimensions. More specifically, according to the present invention, the apex seal of 2.3 mm thick has the impact resistance comparable to that of the conventional apex seal of 3.0 mm thick.

Thus, according to the present invention, it is possible to decrease the thickness of the apex seal so that the mass of the apex seal can be correspondingly decreased. This leads to a decrease in the sliding drag and an improvement in the engine performance.

In the arrangement of the apex seal as shown in FIGS. 1(*a*) and (*b*), the reduction in the thickness of the apex seal provides further advantages. As shown in FIG. 1(*a*), there is a gap 9 at the end of the apex seal 1 and the volume of the gap 9 is decreased as the thickness of the apex seal decreases. Therefore, it is possible to decrease gas leakage through the gap 9 resulting in an increase in the brake mean effective pressure or output of the engine and also in an improvement in fuel consumption. In order to confirm the fact, the following test was performed.

Engine Performance Test

Test Procedure:

Two rotary piston engines were provided for the test. Each engine was of two rotor type having a single working chamber displacement of 573 cc. One of the engines was equipped with apex seals of the present invention having the thickness of 2.3 mm. The other engine was equipped with conventional apex seals of 3.0 mm thick. The engines were operated with wide open throttle and the brake mean effective pressure and the brake output were measured under various engine speeds. The results are shown in FIG. 4.

Fuel Consumption Test

Test Procedure:

The above two engines were used for the fuel consumption test. The engines were operated under 1500 rpm and the brake mean effective pressure and the fuel consumption were measured. The results are shown in FIG. 5.

In FIGS. 4 and 5, it will be noted that the thin apex seals are effective to improve the engine performance in respect of the brake mean effective pressure, the output and the fuel consumption. Of course, the present invention is not limited to a specific thickness of the apex seal but it should be noted that according to the present invention there is a substantial room for decreasing the thickness of the apex seal to obtain an improved engine performance.

The invention has thus been described with reference to specific examples, however, it should be noted that the invention is in no way limited to the details of such examples.

We claim:

1. Apex seal for rotary piston engines which is made of an iron-based material consisting essentially of in weight 2.5 to 4.0% of C, 0.5 to 2.8% of Si, less than 1.0% of Mn, 0.25 to 2.0% of Ni, 0.25 to 2.0% of Mo, 0.25 to 2.0% of Cu, 0.15 to 0.4% of B, 0.15 to 1.5% of Cr, 0.1–0.4% of V and the balance of substantially iron, said material being of chilled structure throughout the apex seal.

2. Apex seal for rotary piston engines as claimed in claim 1, wherein said material is of chilled structure throughout the apex seal provided by casting without any specific cooling means.

* * * * *